US005214851A

United States Patent [19]

Althaus

[11] Patent Number: 5,214,851

[45] Date of Patent: Jun. 1, 1993

[54] RAZOR

[75] Inventor: Wolfgang Althaus, Wuppertal-Cronenberg, Fed. Rep. of Germany

[73] Assignee: Wilkinson Sword Gesellschaft mit beschränkter Haftung, Solingen, Fed. Rep. of Germany

[21] Appl. No.: 568,267

[22] Filed: Aug. 15, 1990

[30] Foreign Application Priority Data

Aug. 17, 1989 [DE] Fed. Rep. of Germany ... 8909835[U]

[51] Int. Cl.[5] ..... B26B 19/28

[52] U.S. Cl. ..... 30/45; 30/44

[58] Field of Search ..... 30/42, 44, 45

[56] References Cited

U.S. PATENT DOCUMENTS

| | | | |
|---|---|---|---|
| 2,319,815 | 5/1943 | Harshberger | 30/44 |
| 3,157,804 | 11/1964 | Goodwin | 30/45 |
| 3,636,627 | 1/1972 | Tiffin | 30/45 |
| 4,642,892 | 2/1987 | Ishida | 30/44 |
| 4,819,330 | 4/1989 | Fenn et al. | 30/45 |
| 5,007,169 | 4/1991 | Motta | 30/45 |

*Primary Examiner*—Mark Rosenbaum
*Assistant Examiner*—John M. Husar
*Attorney, Agent, or Firm*—Robert W. Becker & Associates

[57] ABSTRACT

A razor is provided having a handle, at the front end of which a razor blade unit is disposed on a razor head, whereby disposed in a housing of the handle is a motor-driven vibration mechanism that imparts a vibration movement to the razor head together with the razor blade unit. The construction of the vibration mechanism is such that the razor blade unit executes a controlled, directed vibration movement while nearly completely avoiding vibration of the handle.

16 Claims, 2 Drawing Sheets

RAZOR

BACKGROUND OF THE INVENTION

The invention relates to a wet razor or safety razor having a handle, at the front end of which a razor blade unit is disposed on a razor head, whereby disposed in a housing of the handle is a motor-driven vibration mechanism that imparts a vibration movement to the razor head together with the razor blade unit.

Wet razors of the aforementioned general type are known. They comprise a handle, at the front end of which a razor blade unit is disposed on a razor head, with a razor blade unit referring to a plastic body in which is fixedly embedded a single or double razor blade. To improve the shaving characteristics, there is provided in the handle housing a vibration mechanism that is driven by a battery-operated electric motor. In this connection, the vibration mechanism imparts to the razor head together with the razor blade unit disposed thereon vibration movements as desired while shaving.

A drawback of these known wet razors is that the vibration characteristics are not optimum. For example, the handle is unfortunately also vibrated, so that as a further drawback the vibration energy is not transferred entirely to the razor blade unit. Furthermore, the vibration transfer is dampened due to the fact that the handle is made of plastic, thus also impairing the vibration effect. In addition, with the known wet razors it is possible to establish only a single vibration frequency, which always represents a compromise. Thus, for example, for a light beard or for sensitive areas, such as the neck, the vibration frequency is always too great, whereas when shaving a heavy beard or areas having a dense beard growth, the vibration frequency is too small. A further drawback of the known wet razors is the split plastic handle housing, with the parts of the housing being ultrasonically fused during assembly. These fused connections are frequently loosened due to the vibrations, which can lead to an alteration of the vibration characteristic, which then reduces the operativeness of the wet razor. In addition, due to the loosened fused connection or due to an incorrectly carried-out fusing connection, water can enter the interior of the razor, which leads to a rapid destruction of the operative parts. Finally, a drawback of the known wet razors is that they have disruptive transverse vibrations.

Proceeding from the above, it is an object of the invention to provide a wet razor that has improved vibration characteristics.

SUMMARY OF THE INVENTION

The technical approach proposed by the invention is that the vibration mechanism be embodied in such a way that the razor blade unit executes a controlled, directed vibration movement while nearly completely avoiding vibration of the handle.

A wet razor embodied in this manner is characterized by improved vibration characteristics and as a result thereof by improved shaving characteristics. A first advantage is that the handle, if at all, vibrates only very little, which on the one hand increases the operating or control comfort and on the other hand means that the vibration energy is transferred nearly entirely to the razor blade unit. A further improvement of the shaving result is achieved by the controlled, directed vibration movement, so that the razor blade unit vibrates in only a single direction without the overlap of transverse vibrations. In this connection, the vibration movements extend, combined with the actual shaving movement, transverse to the cutting direction, i.e. in the direction of the cutting edges of the razor blades. As an alternative to this main direction of vibration, the vibration movement could also be disposed in the direction of the shaving movement.

Pursuant to one structural embodiment of the inventive wet razor, it is proposed that a carrier for the vibration mechanism be connected essentially rigidly with the razor head that carries the razor blade unit, and that the structural unit that comprises the carrier for the vibration mechanism and the razor head with the razor blade unit be pivotably mounted in the exit or outlet region out of the front end of the housing of the handle. A wet razor that is embodied in this manner, due to the special connection as well as the mounting of the vibration mechanism and the razor blade unit, has the advantage that in a structurally straightforward manner only the razor head together with its razor blade unit vibrates, whereas the handle is nearly completely free of vibrations.

In a structural embodiment, the housing of the handle is preferably provided at the front end with an opening having a square or rectangular cross-sectional configuration, with the connection of the carrier for the vibration mechanism with the razor head being formed by a parallelepipedal member that is pivotably mounted in the opening. This represents a technically straightforward possibility for pivotably mounting the previously described structural unit at the front end of the handle.

The vibration mechanism is preferably disposed in a vibrator housing that for the vibration movements is accommodated with play within the housing of the handle. This vibrator housing thus forms the carrier for the vibration unit, whereby the vibrator housing can accommodate all of the parts that are necessary for generating the vibrations.

Pursuant to a further embodiment, the housing of the handle is predominately made of metal. Such a metal handle housing has the advantage that the vibration transfer can be effected in a less dampened manner than occurred, for example, with a plastic handle housing. Furthermore, due to the greater weight, a handle housing of metal leads to a distinctly reduced housing vibration than is the case with, for example, a plastic housing.

Pursuant to a further embodiment, the housing of the handle is embodied as a single piece. In this connection, the handle housing is preferably made of metal although it can also be made of plastic. The one-piece housing construction primarily has the advantage that the transfer of vibration to the razor head with the razor blade unit is effected in an optimum manner. In contrast to the conventional split handle housing, the vibrations cannot loosen any fused connections, so that the vibration characteristic is not altered and hence a uniform operativeness is achieved. Furthermore, with the one-piece handle housing there is no longer the danger that, for example due to loosened or incorrectly carried-out fused connections, water can enter the interior of the razor, so that with the one-piece construction, destruction of the operative parts is avoided.

It is furthermore proposed in a further embodiment that the outside of the housing of the handle be provided with an elastic, vibration-damping coating. This coating is preferably made of rubber, especially synthetic rubber. In addition to a distinctly reduced vibration in the handle region, a better comfort is also achieved with this feature.

It is proposed pursuant to a further embodiment that a switch be disposed on the handle to operate the vibration mechanism with different frequencies, especially with two different frequencies. Thus, at two speeds with two different frequencies, the user has the possibility of using the lower frequency for light beards or for sensitive areas, such as the neck. The higher frequency is used for heavier beards or for areas with a dense beard growth.

Pursuant to a preferred further embodiment of the vibration mechanism, this mechanism comprises two eccentrics that operate synchronously in opposite directions, with the common center of gravity of these eccentrics moving back and forth parallel to the longitudinal dimension of the razor blade unit. In this way, a controlled, directed vibration movement is provided in only a single direction, and in particular parallel to the cutting edge of the razor blade that is embedded in the razor blade unit. In so doing, no disruptive transverse vibrations occur. At the least, such vibrations are reduced to a tolerable level.

This eccentric principle can be structurally carried out in that the eccentrics, which operate synchronously in opposite directions, are formed by two gear wheels that mesh with one another via the same number of teeth, with each of the gear wheels being provided with imbalancing means, whereby one of the gear wheels is mounted on the rotating shaft of the motor, and the other gear wheel is mounted in the carrier of the vibration mechanism. By means of such a gear mechanism, it is possible in a technically straightforward manner to obtain an oppositely directed eccentric drive that in a satisfactory manner permits a vibration movement that is only parallel to the cutting edge of the razor blade.

In this connection, the shaft of the motor is preferably disposed in the longitudinal central axis of the housing of the handle. However, as an alternative it would also be conceivable to eccentrically dispose the motor shaft itself, so that the shaft of the second gear wheel could then be disposed exactly in the longitudinal central axis of the housing of the handle.

BRIEF DESCRIPTION OF THE DRAWINGS

One exemplary embodiment of an inventive wet razor or safety razor having a vibration mechanism will be described subsequently in conjunction with the drawing, in which:

FIG. 2 is a cross-sectional view taken along the line II—II in

FIG. 1; and

DESCRIPTION OF PREFERRED EMBODIMENTS

Figure 1:
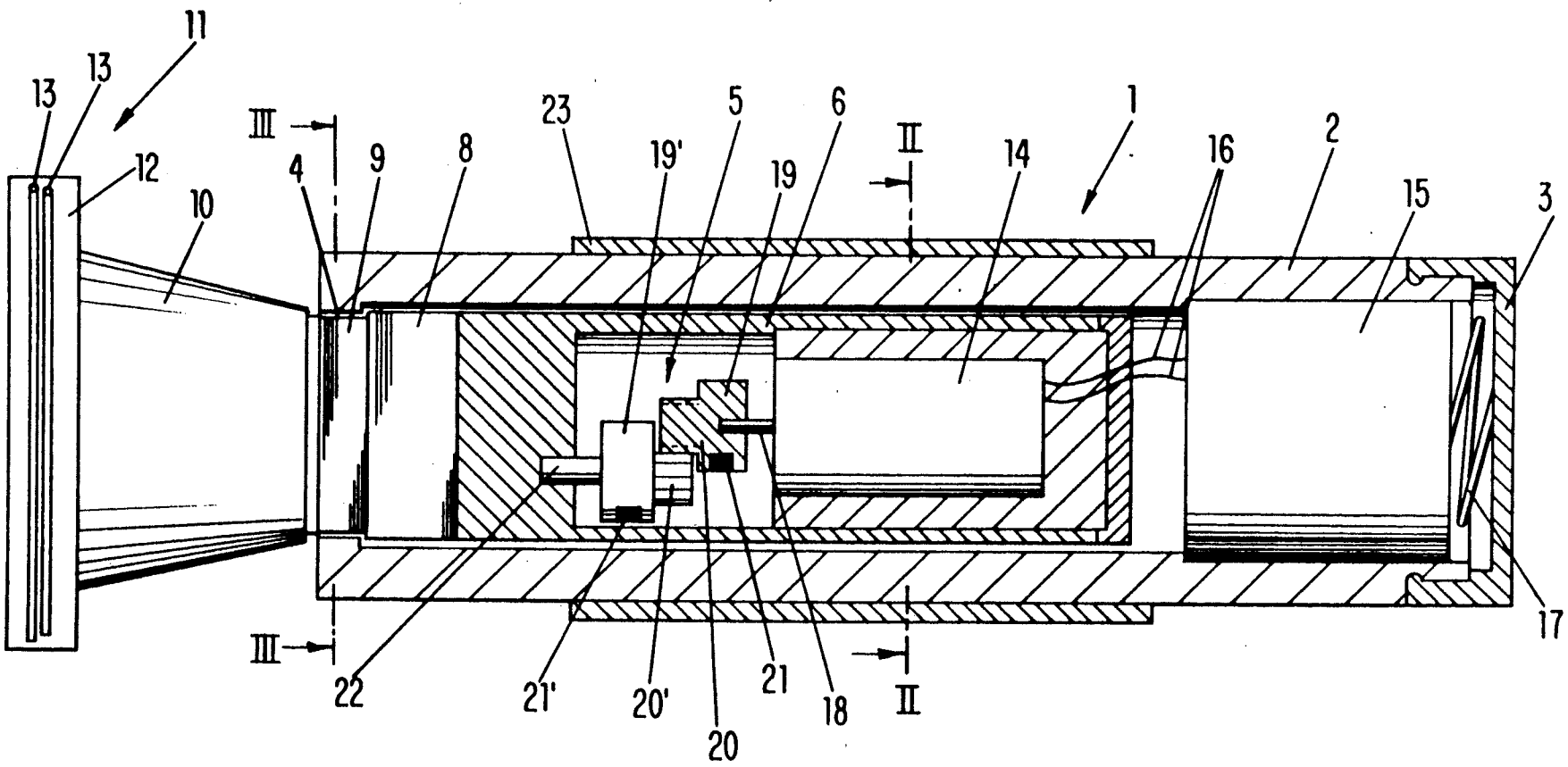
FIG. 1 is a schematic longitudinal cross-sectional view through the wet razor.
Figure 2:
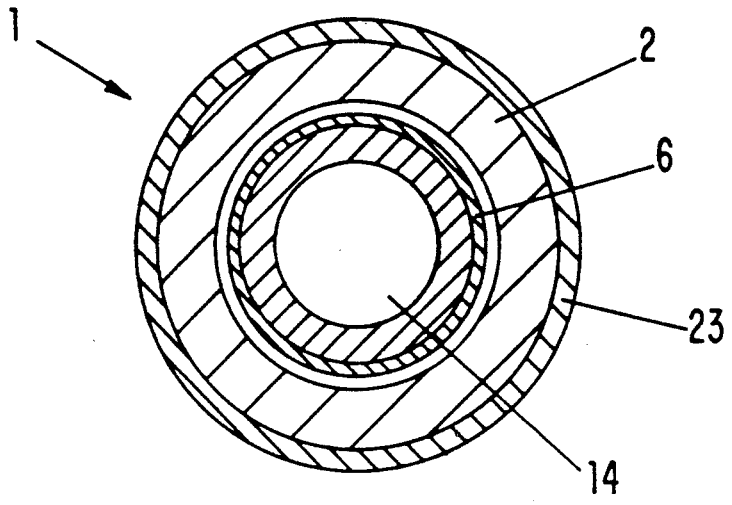
Figure 3:
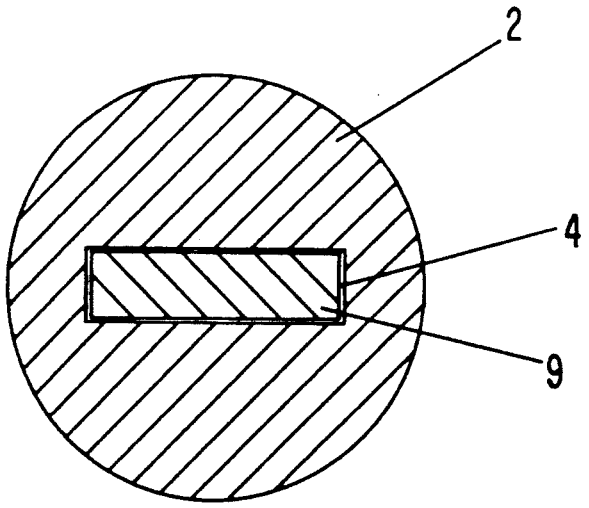
FIG. 3 is a cross-sectional view of the inventive razor in the region of the parallelapipedal member and is taken along the line III—III in FIG. 1.

The wet razor comprises a handle 1. This handle is formed by an essentially hollow cylindrical metal housing 2, the open rear end of which is closed off by a cover 3. In so doing, the cover is connected with the housing 2 via a snap mechanism. The front end of the housing 2 is provided with an opening 4 having a square or rectangular cross-sectional configuration Disposed within the housing 2 of the handle 1 is a vibration mechanism 5. This mechanism primarily comprises a vibrator housing 6 that is similarly embodied essentially as a hollow cylinder, with the outer diameter of this vibrator housing 6 being somewhat less than the inner diameter of the housing 2 for the handle 1, so that the vibrator housing 6 has a little bit of clearance relative to the housing 2. The rear end of the vibrator housing 6 is similarly closed off by a cover 7. A parallelepipedal member 8 is secured to the front end of the vibrator housing 6, for example by being glued thereto. This member in turn carries a similarly embodied parallelepipedal member 9, which is disposed in the opening 4 of the housing 2 for the handle 1. Finally, secured to the parallelepipedal member 9, outside the housing 2 for the handle 1, is a razor head 10 that at its front end carries a so-called razor blade unit 11, which comprises a razor blade 13, in the form of a double razor blade, that is fixedly embedded in a plastic body 12.

The vibrator housing 6 with the cover 7, the member 8, the parallelepipedal member 9, as well as finally the razor head 10 with the razor blade unit 11, thus form a structural unit. This unit is pivotably mounted within the housing 2 for the handle 1, with the pivot point being defined by the parallelepipedal member 9 within the opening 4. Thus, in the vicinity of where this unit exits the front end of the housing 2, this unit is pivotably mounted, with the pivoting movement being possible due to the play or clearance that exists between the vibrator housing 6 and housing 2 for the handle 1.

The vibration mechanism 5 itself comprises a motor 14 in the form of an electric motor, which is fixedly disposed in the rear portion of the vibrator housing 6. Electrical power is supplied to this motor 14 from a battery 15 via electrical leads 16. In this connection, the battery 15 is inserted into the housing 2 for the handle 1 from the rear, and is held in place by the cover 3. A spring 17 is supported between the back end of the battery 15 and the inner surface of the cover 3.

The shaft 18 of the motor 14 is disposed in the longitudinal central axis of the handle 1 and carries a first gear wheel 19. The driver portion of this first gear wheel is provided with a specific number of teeth 20. Above all, however, this gear wheel 19 is provided with an imbalancing means 21. The gear wheel 19 meshes with a second gear wheel 19', the shaft 22 of which is freely rotatably mounted in the vibrator housing 6. This second gear wheel 19' has teeth 20', the number of which corresponds to the number of teeth of the first gear wheel 19. Finally, the second gear wheel 19' is also provided with an imbalancing means 21'.

It should also be noted that the housing 2 for the handle 1 is provided in the gripping region with a coating 23 of a soft, vibration-dampening synthetic rubber.

The wet razor with its vibration mechanism 5 operates as follows:

The motor 14 is turned on, so that the shaft 18 thereof rotates at a certain speed and hence with a certain rotational frequency. The gear wheel 19, which is fixedly mounted on the shaft 18 of the motor, rotates in conformity therewith and thereby drives the gear wheel 19' in a synchronous manner but in an opposite direction. The The arrangement of the two imbalancing means 21, 21' in the gear wheels 19, 19' is such that the common center of gravity of the two gear wheels 19, 19' is always disposed in a fixed plane that extends parallel to the cutting edges of the two razor blades 13. In the drawing, this is the plane of the paper. In this way, the common center of gravity of the two gear wheels 19, 19' always wanders back and forth in the plane of the paper. Thus, due to the pivotable suspension of the structural unit within the forward opening 4 in the housing 2 for the handle 1, the razor head 10 with its razor blade unit 11 has imparted thereto a vibration movement that extends in the plane of the paper. Transverse movements that are perpendicular thereto (i.e. perpendicular to the plane of the paper) do not occur.

By means of a non-illustrated selector switch, two speeds can be established for the motor 14. This leads to two different speeds and hence to two different vibration frequencies. The lower frequency is used for light beards or for sensitive areas, such as the neck, while the higher frequency is used for heavier beards or for areas having a dense beard growth.

The present invention is, of course, in no way restricted to the specific disclosure of the specification and drawings, but also encompasses any modifications within the scope of the appended claims.

What I claim is:

1. In a razor having a handle, at a front end of which a razor blade unit is disposed on a razor head, whereby disposed in a housing of said handle is a motor-driven vibration mechanism that imparts a vibration movement to said razor head and said razor blade unit thereof, the improvement wherein:

said vibration mechanism includes a carrier means that is connected essentially rigidly with said razor head to thereby together form a single structural unit that is pivotably supported in said handle housing such that it can vibrate and execute a controlled, directed vibration movement of said razor blade unit while nearly completely avoiding vibration of said handle, with said single structural unit, which is comprised of said carrier means of said vibration mechanism and said razor head with said razor blade unit thereof, being pivotably mounted in the vicinity of where said structural unit emerges from a front end of said housing of said handle.

2. A razor according to claim 1, in which said front end of said housing of said handle is provided with an opening having a quadrilateral cross-sectional configuration; and which includes a parallelepipedal member that forms said connection between said carrier means and said razor head, with said parallelepipedal member being pivotably mounted in said opening to effect said pivotable mounting of said structural unit.

3. A razor according to claim 2, in which said vibration mechanism comprises two eccentrics that operate synchronously and in opposite directions, with said eccentrics having a common center of gravity that moves parallel to a longitudinal dimension of said razor blade unit.

4. A razor according to claim 3, in which said eccentrics are formed by two gear wheels that mesh with one another via an identical number of teeth, with each of said gear wheels being provided with an imbalancing means; one of said gear wheels is mounted on a rotating shaft of a motor for said vibration mechanism, and the other of said gear wheels is mounted in said carrier means of said vibration mechanism to thereby impart vibration movement to said structural unit and hence to said razor blade unit.

5. A razor according to claim 4, in which said rotating shaft of said motor is disposed exactly in a longitudinal central axis of said housing of said handle.

6. A razor according to claim 2, in which said carrier means comprises a vibration housing in which said vibration mechanism is disposed, whereby for said vibration movement, said vibrator housing is accommodated with play within said housing of said handle.

7. A razor according to claim 6, in which said housing of said handle is made predominantly of metal.

8. A razor according to claim 7, in which said housing of said handle has a one-piece construction.

9. A razor according to claim 8, in which said housing of said handle is provided with a resilient, vibration-damping coating.

10. A razor according to claim 9, in which said coating is rubber.

11. A razor according to claim 9, in which said coating is synthetic rubber.

12. A razor according to claim 1, in which said handle is provided with switch means to operate said vibration mechanism at different frequencies.

13. A razor according to claim 1, in which said handle is provided with switch means to operate said vibration mechanism at two different frequencies.

14. A razor according to claim 1, in which said structural unit is pivotably supported in said handle housing such that it can vibrate and execute a controlled vibration movement in a single direction while nearly completely avoiding vibration of said handle.

15. A razor according to claim 14, in which said structural unit executes a controlled vibration movement in the direction of cutting edge means of said razor blade means.

16. A razor according to claim 14, in which said structural unit executes a controlled vibration movement in the direction of shaving movement, which is transverse to cutting edge means of said razor blade means.

* * * * *